US007497729B1

(12) United States Patent
Wei

(10) Patent No.: US 7,497,729 B1
(45) Date of Patent: Mar. 3, 2009

(54) MINI-COAXIAL CABLE CONNECTOR

(75) Inventor: Kai-Chih Wei, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 12/007,287

(22) Filed: Jan. 9, 2008

(51) Int. Cl.
*H01R 9/05* (2006.01)

(52) U.S. Cl. ..... 439/578; 439/583; 439/584

(58) Field of Classification Search ..... 439/578, 439/583, 584
See application file for complete search history.

(56) References Cited

U.S. PATENT DOCUMENTS 5,354,217 A * 10/1994 Gabel et al. ..... 439/583
5,435,745 A * 7/1995 Booth ..... 439/584
6,019,635 A * 2/2000 Nelson ..... 439/583
6,848,931 B2 * 2/2005 McMullen et al. ..... 439/350

* cited by examiner

*Primary Examiner*—Tho D Ta
(74) *Attorney, Agent, or Firm*—Rosenberg, Klein & Lee

(57) ABSTRACT

A mini-coaxial cable includes a main body being provided with a forward tapered inner wall surface and a plurality of internal screw threads; and an adapter for coaxially receiving a mini-coaxial cable therein and including a first forward tapered tubular section, a plurality of external screw threads meshing with the internal screw threads of the main body, and at least one pair of wedge-shaped members located adjacent to the outer sheath of the mini-coaxial cable. When the adapter is fully screwed into the main body, the wedge-shaped members are subjected to radially applied forces and inward deformed to tightly press against and grip the outer sheath of the mini-coaxial cable, and the first tapered tubular section drives the braided sheath of the mini-coaxial cable against the tapered inner wall surface of the main body, giving the mini-coaxial cable sufficient pull strength.

4 Claims, 5 Drawing Sheets

MINI-COAXIAL CABLE CONNECTOR

FIELD OF THE INVENTION

The present invention relates to a mini-coaxial cable connector, and more particularly to a connector that utilizes screwing mechanism to enable a mini-coaxial cable received in an adapter to be easily connected to a main body of the connector while ensuring good quality signal transmission.

BACKGROUND OF THE INVENTION

A mini-coaxial cable connector is used to mechanically and electrically connect a mini-coaxial cable to a corresponding interface on an electronic device for cable TV signal transmission, data transmission, etc. FIG. 1 shows an existing mini-coaxial cable connecting technique. The term "mini-coaxial cable" used throughout this document means a coaxial cable having a center conductor diameter larger than 0.1 mm and smaller than 0.8 mm, such as RG179 coaxial cable. As shown, a conventional mini-coaxial cable 10 includes a center conductor 11, an insulating spacer 12 surrounding the center conductor 11, at least one layer of braided sheath 13 surrounding the insulating spacer 12, and an outer sheath 14 surrounding the braided sheath 13; and a conventional mini-coaxial cable connector 15 includes an inner conducting body 16 and an insertion pin 17 for inserting into an axial guide way in the connector 15 to mechanically and electrically connect to the inner conducting body 16. The insertion pin 17 is provided in a rear end with a cylindrical recess 18. According to the prior art, the insertion pin 17 is first soldered to the center conductor 11 located at a stripped front end of the mini-coaxial cable 10. To solder the insertion pin 17 to the bare center conductor 11 requires electric power and clean and bright working environment. Once the mini-coaxial cable 10 with the insertion pin 17 soldered thereto has been assembled to the mini-coaxial cable connector 15, a collar 19 is fitted around the outer sheath 14 at the front end of the mini-coaxial cable 10 and then crimped using a crimping tool, so that the mini-coaxial cable 10 is tightly connected to the connector 15.

The above-described manner of assembling the mini-coaxial cable to a mini-coaxial cable connector is troublesome, and it is therefore desirable to develop a solder-free and crimp-free connecting structure for stably and firmly connecting a mini-coaxial cable to a mini-coaxial cable connector.

SUMMARY OF THE INVENTION

A primary object of the present invention is to provide a mini-coaxial cable connector that utilizes a screwing mechanism to allow convenient and stable connection of a mini-coaxial cable thereto.

Another object of the present invention is to provide a mini-coaxial cable connector that ensures a mini-coaxial cable connected thereto to have sufficient pull strength.

A further object of the present invention is to provide a mini-coaxial cable connector that includes means for firmly pressing against and gripping the outer sheath of a mini-coaxial cable to thereby achieve firm connection of the mini-coaxial cable to the connector.

To achieve the above and other objects, the mini-coaxial cable connector according to the present invention includes a main body and an adapter.

The main body is provided at a predetermined position with a forward tapered inner wall surface and a plurality of internal screw threads located in a rear portion of the main body.

The adapter has a mini-coaxial cable coaxially received therein, and includes a first tubular section, an interconnecting section, and at least one pair of wedge-shaped members. The first tubular section has a forward tapered outer wall surface adapted to tightly fit in the forward tapered inner wall surface of the main body. The interconnecting section is provided with a plurality of external screw threads adapted to mesh with the internal screw threads in the main body. The wedge-shaped members are disposed on the interconnecting section to locate adjacent to an outer sheath of the mini-coaxial cable.

When the adapter is fully screwed into the main body, the wedge-shaped members are subjected to forces radially applied thereto by the main body and inward deformed to tightly press against and grip the outer sheath of the mini-coaxial cable. Meanwhile, the forward tapered outer wall surface of the first tubular section of the adapter drives a part of the braided sheath of the mini-coaxial cable against the forward tapered inner wall surface of the main body. With these arrangements, the mini-coaxial cable received in the mini-coaxial cable connector has sufficient pull strength.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 7A:
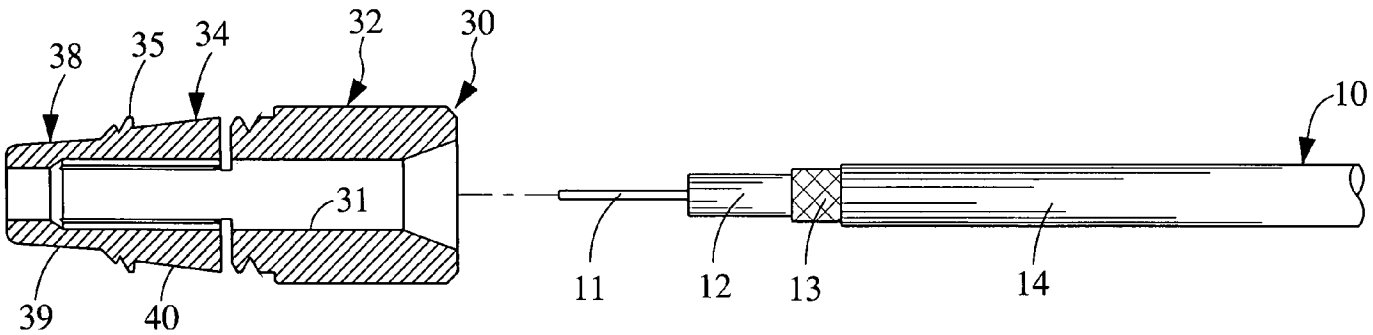
FIGS. 7A to 7C show the steps of connecting a mini-coaxial cable to the connector of the present invention.

As can be seen from FIG. 7A, a general mini-coaxial cable 10 may be stripped at a front end using a stripper, so that a length of the outer sheath 14 thereat is removed to expose part of the center conductor 11, the insulating spacer 12, and the braided sheath 13.

Figure 1:
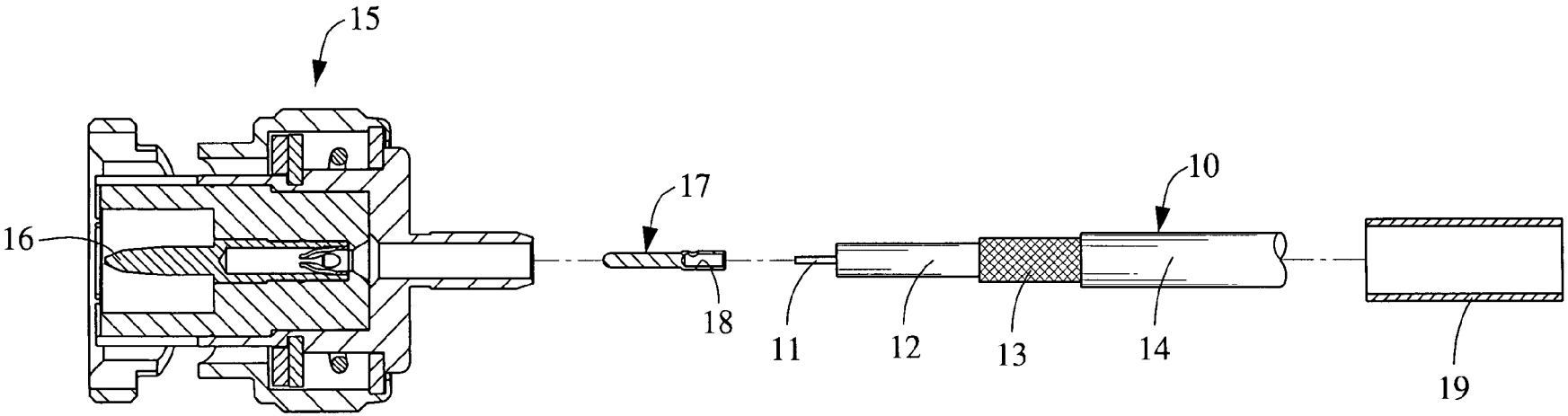
PRIOR ART FIG.1
FIG. 1 is an exploded sectional view showing the connection of a mini-coaxial cable to a conventional mini-coaxial cable connector.
Figure 2:
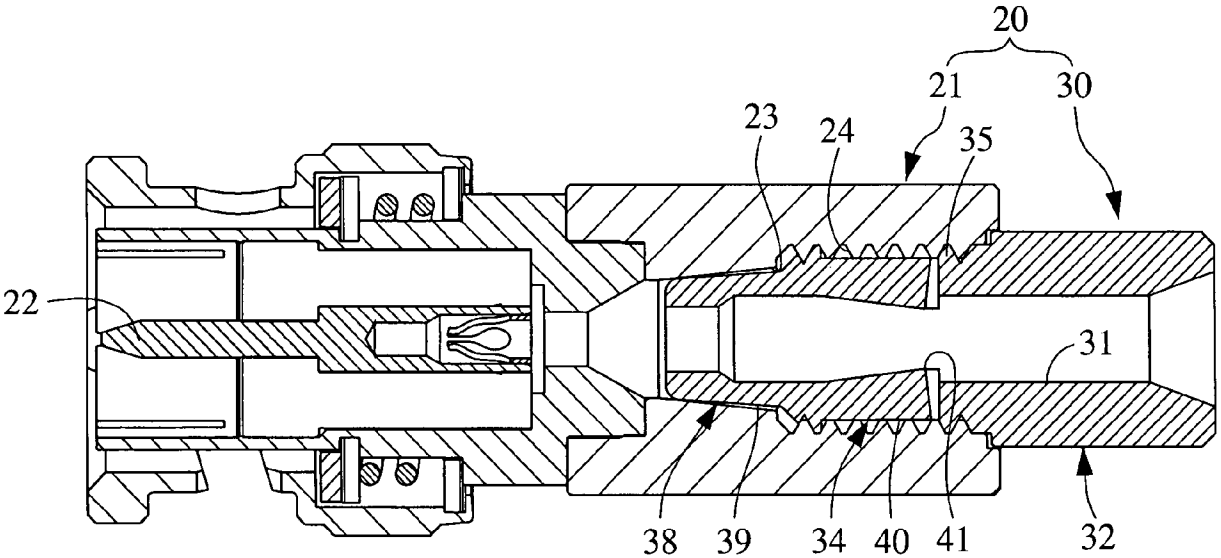
FIG. 2 is an assembled longitudinal sectional view of a mini-coaxial cable connector according to the present invention.

Please refer to FIG. 2. A mini-coaxial cable connector 20 according to the present invention includes a main body 21 and an adapter 30. The main body 21 may be configured into a variety of connection interfaces, including F, BNC, RCA, IEC connectors, etc. The present invention will now be described based on a BNC connector.

Figure 3:
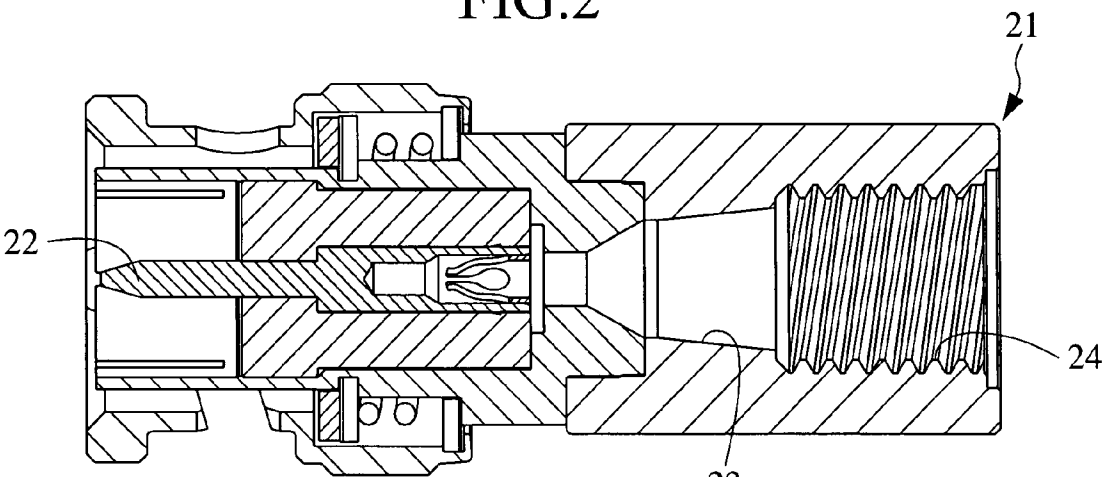
FIG. 3 is a longitudinal sectional view of a main body of the mini-coaxial cable connector of FIG. 2.

As shown in FIG. 3, the main body 21 of the mini-coaxial cable connector 20 of the present invention has a front portion formed into a fastener, in which an inner conducting body 22 is provided. The fastener may be coupled to an electronic device with the inner conducting body 22 mechanically and electrically connected to a corresponding interfacing connector on the electronic device. The main body 21 has a rear portion internally provided with a forward tapered inner wall surface 23 and a plurality of internal screw threads 24 located behind the forward tapered inner wall surface 23.

Figure 4:
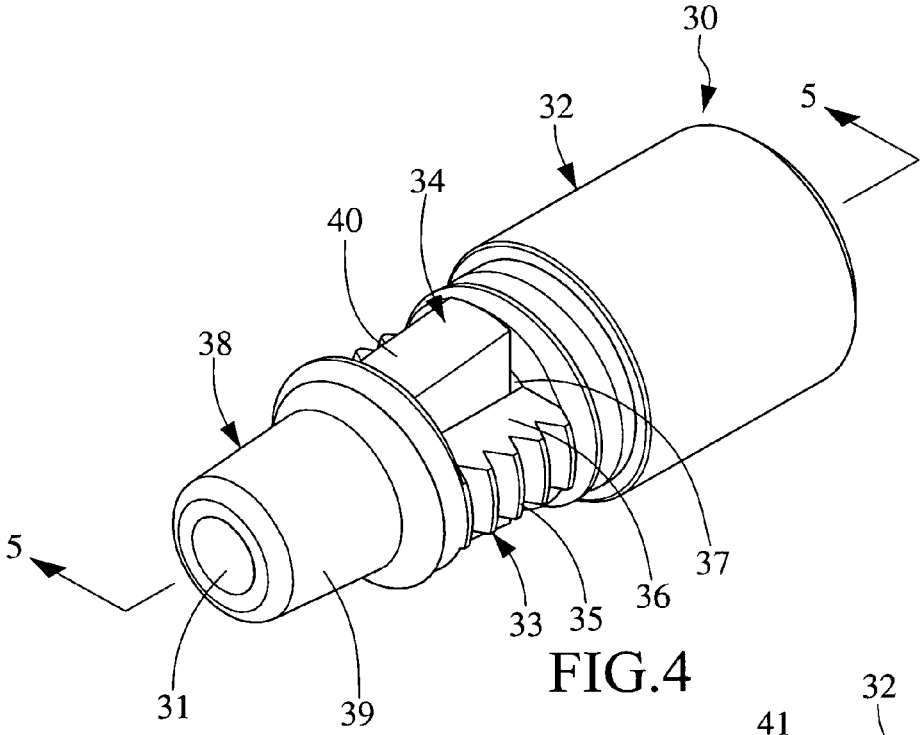
FIG. 4 is a perspective view of an adapter of the mini-coaxial cable connector of FIG. 2.
Figure 5:
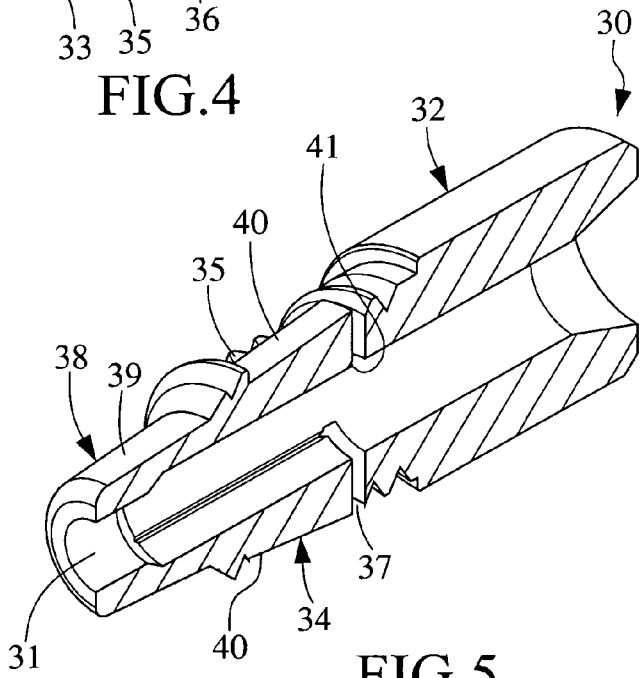
FIG. 5 is a sectioned perspective view taken along line 5-5 of FIG. 4.
Figure 6:
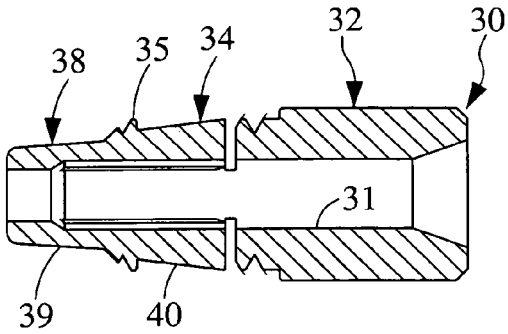
FIG. 6 is a sectioned side view of the adapter of FIG. 4.
Figure 7B:
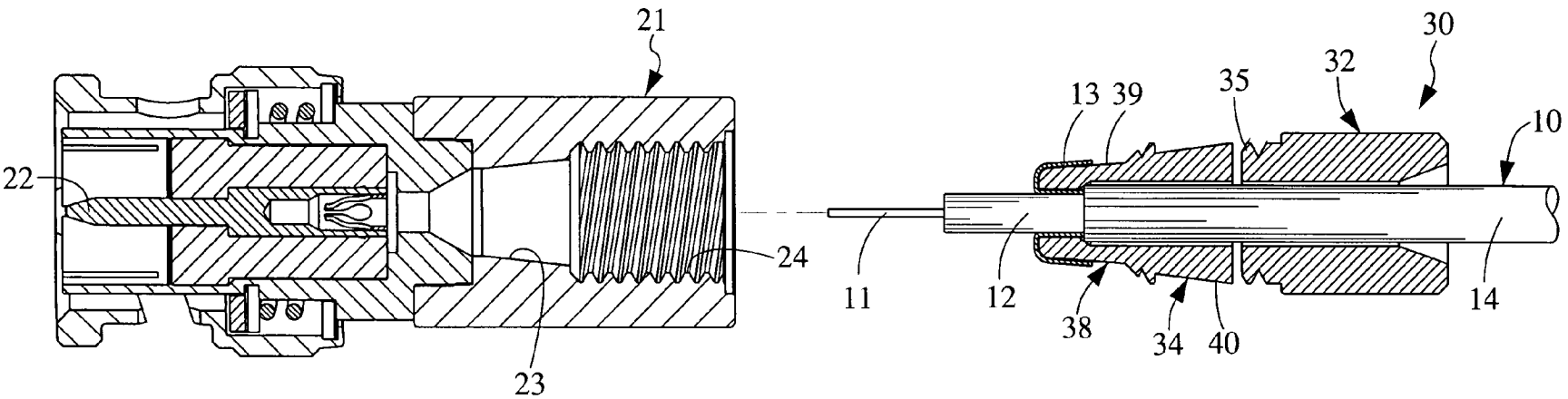

Please refer to FIGS. 4 to 6. The adapter 30 of the mini-coaxial cable connector 20 of the present invention internally defines an axially extended passage 31, which has an inner diameter large enough for receiving the front end of the mini-coaxial cable 10 therein while allowing the bare center conductor 11 and part of the exposed insulating spacer 12 and braided sheath 13 to forward extended from an open front end of the adapter 30, as shown in FIG. 7A. The lengths of the bare center conductor 11 and the exposed insulating spacer 12 and braided sheath 13 forward extended from the adapter 30 are in compliance with relevant industrial standards. The exposed braided sheath 13 is turned back to cover an outer side of the front end of the adapter 30, as shown in FIG. 7B.

Figure 7C:
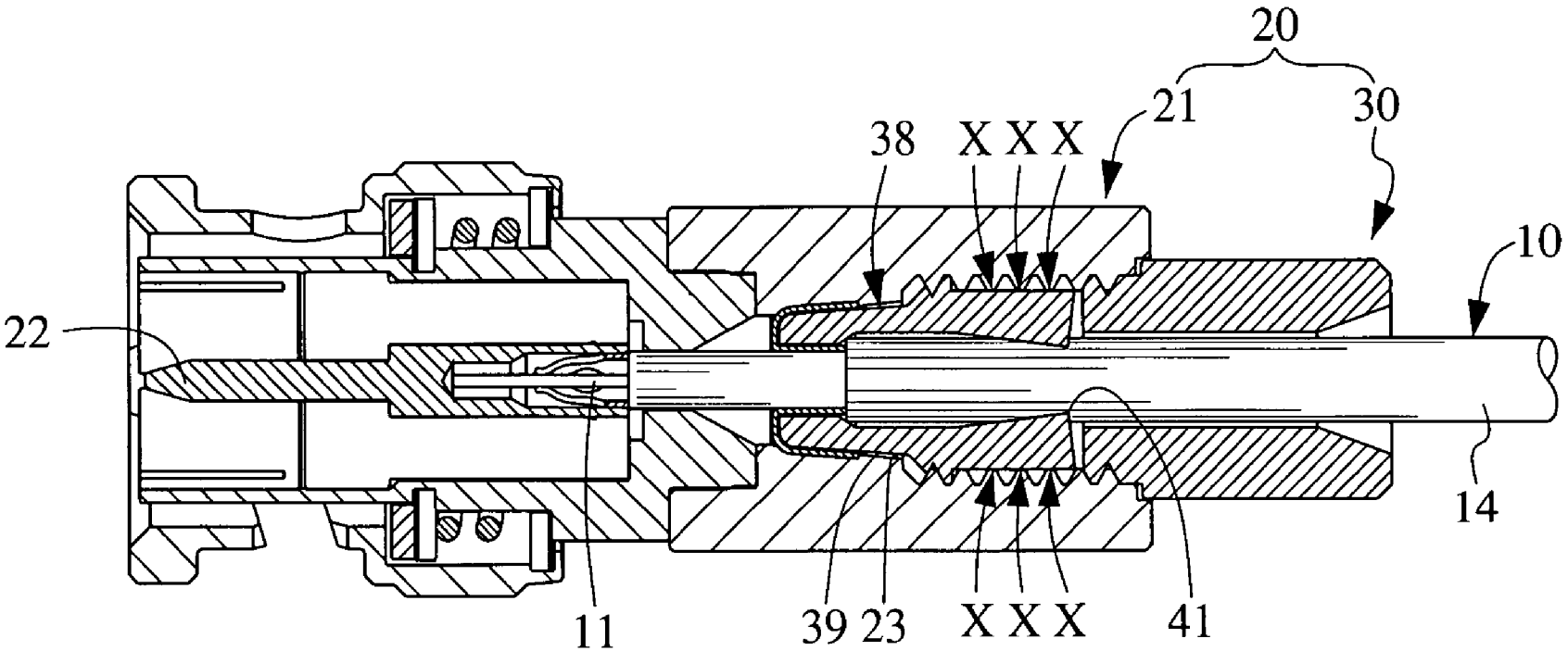

The adapter 30 includes a first tubular section 38, a second tubular section 32 located behind the first tubular section 38, a interconnecting section 33 located between the first and the second tubular section 38, 32, and at least one pair of wedge-shaped members 34. The interconnecting section 33 is provided with a plurality of external screw threads 35 adapted to mesh with the internal screw threads 24 in the main body 21, so that an assembly of the adapter 30 and the main body 21 may be electrically connected to the mini-coaxial cable 10, as shown in FIG. 7C. The interconnecting section 33 is provided at an upper and a lower side with a flat plane 36 each. A square opening 37 is formed on each of the two flat planes 36, and the wedge-shaped members 34 are separately disposed in the square openings 37 to locate adjacent to the outer sheath 14 of the mini-coaxial cable 10 received in the adapter 30. The wedge-shaped members 34, the first tubular section 38, and the second tubular section 32 are integrally formed.

The first tubular section 38 has a forward tapered outer wall surface 39 adapted to tightly fit in the forward tapered inner wall surface 23 in the rear portion of the main body 21. Therefore, when the adapter 30 is screwed into the rear portion of the main body 21, the forward tapered outer wall surface 39 of the first tubular section 38 will drive the exposed braided sheath 13 of the mini-coaxial cable 10 in front of the adapter 30 against the tapered inner wall surface 23 of the main body 21 to ensure a reliable electrical connection of the mini-coaxial cable 10 with the main body 21.

The wedge-shaped members 34 have a forward inclined top surface 40 each. When the inclined top surfaces 40 are subjected to a force applied thereto in radial directions as indicated by the arrows X in FIG. 7C, the inclined top surfaces 40 are forced to displace toward a center of the passage 31, and accordingly, apply a force against the outer sheath 14 of the mini-coaxial cable 10 adjacent to the wedge-shaped members 34. At this point, rear inner surfaces 41 of the wedge-shaped members 34 are tightly pressed to grip the outer sheath 14, as shown in FIG. 7C.

Please refer to FIGS. 7A to 7C that show the steps of assembling the mini-coaxial cable 10 to the connector 20 of the present invention. First, the properly stripped front end of the mini-coaxial cable 10 is inserted into the adapter 30 via a rear open end thereof, so that the bare center conductor 11 and part of the exposed insulating spacer 12 and braided sheath 13 are forward extended from the open front end of the adapter 30, as shown in FIGS. 7A and 7B.

Then, the exposed braided sheath 13 is turned back to cover a front outer surface of the first tubular section 38 of the adapter 30, and the adapter 30 with the mini-coaxial cable 10 assembled thereto is screwed into the main body 21 of the connector 20, so that the external screw threads 35 of the adapter 30 and the internal screw threads 24 of the main body 21 are fully meshed with one another, as shown in FIGS. 7B and 7C.

In the course of screwing the adapter 30 into the main body 21, the wedge-shaped members 34 on the adapter 30 are subjected to forces radially applied thereto by the rear portion of the main body 21, and thereby moved inward to firmly press against and grip the outer sheath 14 of the mini-coaxial cable 10, preventing the mini-coaxial cable 10 from sliding rearward to separate from the adapter 30. As a result, the adapter 30 is driven into the main body 21 to locate at a finally assembled position. At this position, the forward tapered outer wall surface 39 of the first tubular section 38 firmly drives the exposed braided sheath 13 of the mini-coaxial cable 10 covering the front outer surface of the first tubular section 38 against the tapered inner wall surface 23 of the main body 21, giving the mini-coaxial cable 10 a sufficient pull strength; and the bare center conductor 11 is inserted into the inner conducting body 22 to form an electrical connection thereto, as shown in FIG. 7C.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A mini-coaxial cable connector for mechanically and electrically connecting to a mini-coaxial cable, the mini-coaxial cable including a center conductor, an insulating spacer surrounding the center conductor, at least one layer of braided sheath surrounding the insulating spacer, and an outer sheath surrounding the braided sheath; the mini-coaxial connector comprising:

a main body provided at a predetermined position with an annular forward tapered inner wall surface and a plurality of internal screw threads located in a rear portion of the main body; and an adapter for coaxially receiving the mini-coaxial cable therein and including a first tubular section and an interconnecting section; the first tubular section having a forward tapered outer wall surface defining a contiguous annular contour, the forward tapered outer wall surface adapted to tightly fit in the forward tapered inner wall surface of the main body; the interconnecting section being provided with a plurality of external screw threads adapted to mesh with the internal screw threads in the main body;

whereby when the adapter is fully screwed into the main body, the forward tapered outer wall surface of the first tubular section of the adapter drives part of the braided sheath of the mini-coaxial cable coaxially received in the adapter against the forward tapered inner wall surface of the main body, giving the mini-coaxial cable in the connector a sufficient pull strength.

2. The mini-coaxial cable connector as claimed in claim 1, wherein the adapter further includes a second tubular section located behind the first tubular section, and the interconnecting section is located between the first and the second tubular sections.

3. A mini-coaxial cable connector for mechanically and electrically connecting to a mini-coaxial cable, the mini-coaxial cable including a center conductor, an insulating spacer surrounding the center conductor, at least one layer of braided sheath surrounding the insulating spacer, and an outer sheath surrounding the braided sheath; the mini-coaxial connector comprising:

a main body provided at a predetermined position with a forward tapered inner wall surface and a plurality of internal screw threads located in a rear portion of the main body; and an adapter for coaxially receiving the mini-coaxial cable therein and including a first tubular section and an interconnecting section; the first tubular section having a forward tapered outer wall surface adapted to tightly fit in the forward tapered inner wall surface of the main body; the interconnecting section being provided with a plurality of external screw threads adapted to mesh with the internal screw threads in the main body;

whereby when the adapter is fully screwed into the main body, the forward tapered outer wall surface of the first tubular section of the adapter drives part of the braided sheath of the mini-coaxial cable coaxially received in the adapter against the forward tapered inner wall surface of the main body, giving the mini-coaxial cable in the connector a sufficient pull strength;

wherein the adapter further includes at least one pair of wedge-shaped members disposed on the interconnecting section to locate adjacent to the outer sheath of the mini-coaxial cable received in the adapter; whereby when the adapter is fully screwed into the main body, the wedge-shaped members are subjected to forces radially applied thereto by the main body and inward deformed to tightly press against and grip the outer sheath of the mini-coaxial cable.

4. The mini-coaxial cable connector as claimed in claim 3, wherein the interconnecting section of the adapter is provided at an upper and a lower side with a flat plane each, the flat planes each being provided with a square opening, and the wedge-shaped members being separately disposed in the square openings.

* * * * *